US010770039B1

(12) United States Patent
Hirayama

(10) Patent No.: US 10,770,039 B1
(45) Date of Patent: Sep. 8, 2020

(54) DROP TUNER

(71) Applicant: Meister Works, Inc., Fujiedashi, Shizuoka (JP)

(72) Inventor: Shinjiro Hirayama, Aichi (JP)

(73) Assignee: Meister Works, Inc., Fujiedashi, Shizuoka (JP)

( * ) Notice: Subject to any disclaimer, the term of this patent is extended or adjusted under 35 U.S.C. 154(b) by 0 days.

(21) Appl. No.: 16/559,634

(22) Filed: Sep. 4, 2019

(51) Int. Cl.
*G10D 3/12* (2020.01)
*G10D 3/147* (2020.01)
*G10D 1/08* (2006.01)

(52) U.S. Cl.
CPC ..... *G10D 3/147* (2020.02); *G10D 1/085* (2013.01); *G10D 3/12* (2013.01)

(58) Field of Classification Search
CPC ..... G10D 3/147; G10D 3/12; G10D 1/085
See application file for complete search history.

(56) References Cited

U.S. PATENT DOCUMENTS 4,171,661 A 10/1979 Rose
4,497,236 A 2/1985 Rose
5,359,144 A 10/1994 Benson
2019/0228746 A1* 7/2019 Hackett ..... G10D 1/085

* cited by examiner

*Primary Examiner* — Kimberly R Lockett
(74) *Attorney, Agent, or Firm* — Yokoi & Co., U.S.A.; Toshiyuki Yokoi

(57) ABSTRACT

A drop tuner of the present invention has: a lock screw projected from a main saddle which is rotatably supported by the drop tuner; and a base body supported by the lock screw so as to be capable of being inserted between the lock screw and a fine tuning screw and separated from the fine tuning screw, wherein a rotation angle of the main saddle varies when the base body is switched between an inserted state and a separated state, and a fin member projected toward a radial direction of the lock screw is provided on the base body near an end portion farther from the main saddle.

11 Claims, 15 Drawing Sheets

FIG.4D (A-A)

Related Art

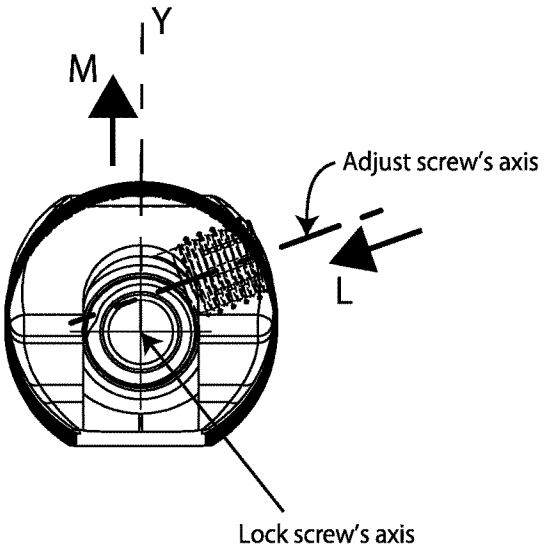
FIG.9E
Related Art
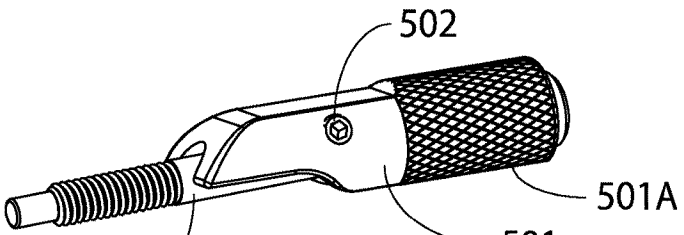
FIG.9A
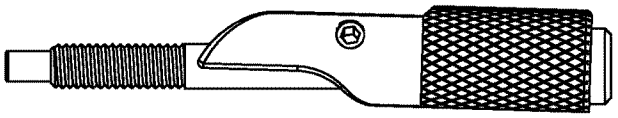
FIG.9B
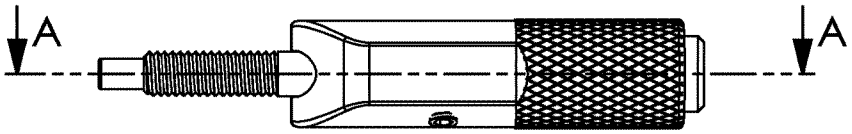
FIG.9C
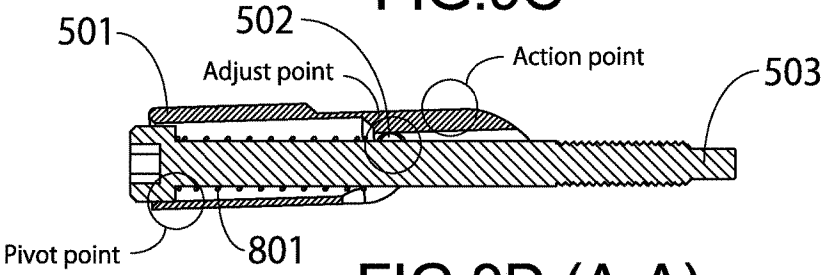
FIG.9D (A-A)

DROP TUNER

CROSS-REFERENCES TO RELATED APPLICATIONS

There are no patent applications filed by me which are related to this patent application.

BACKGROUND OF THE INVENTION

1. Field of the Invention

The present invention relates to a drop tuner structure for a fine tuning bridge of an electric guitar.

2. Description of Related Art

Generally, a drop tuner for a stringed musical instruments has a pitch changing apparatus which produces two distinct pitches for selected strings. By this apparatus, players can change their instruments tuning immediately to the selected tuning between songs. The most popular tuning shift for guitar is to change 6th string tuning from E to D. When a player mounts a drop tuner on the general double locking bridge which has fine tuners as shown by U.S. Pat. No. 4,497,236, the bridge must be fixed against body part by counter spring force so that the bridge does not move by shift motion of a drop tuner. If the counter spring force is not strong enough, the bridge moves around the pivot by shift motion, and the tuning goes out of tune.

The drop tuner of U.S. Pat. No. 5,359,144 is specially designed drop tuner for the general double locking bridge which has fine tuners as shown by U.S. Pat. No. 4,497,236. But there are some difficulties in operation. The biggest problem is, when a player operates the drop tuner of U.S. Pat. No. 5,359,144, it is necessary to pinch it between thumb and index finger because of the drop tuner's shape is like a kind of cylinder. When a player plays the guitar, he usually pinches a pick between thumb and index finger on his right hand, so he must change the pick hold fingers when he operates the drop tuner of U.S. Pat. No. 5,359,144. And this might be a kind of stress for players in some scenes.

Other problem of the drop tuner of U.S. Pat. No. 5,359,144 is that it is difficult to adjust the shift amount precisely because of the structure. The order of physical adjustment points location is, shift action point, adjust point, pivot point. So, the shift action amount is larger than adjust amount, and thus it is difficult to set the shift amount precisely.

Other problem of the drop tuner of U.S. Pat. No. 5,359,144 is that extension line of shift amount adjust screw's axis and the axis of string lock screw which is the axis of shift slide motion don't cross, so rotational moment will be generated on shift amount adjust screw's tip by shift motion. By this way, the shift amount adjust screw tends to rotate easily and the shift amount will be unstable.

And the location of the shift amount adjust screw is not on the centerline of base body. So, the shift amount adjust screw location is better to be changed to the opposite side for left handed guitar players. By this thought, it is better to prepare for right handed model and left handed model, but it might be inventory risk.

This invention improves these problems in the field of a drop tuner for the general double locking bridge which has fine tuners as shown by U.S. Pat. No. 4,497,236.

BRIEF SUMMARY OF THE INVENTION

A drop tuner of the present invention includes a base body movable on a string lock screw and a shift amount adjust screw for adjusting a shift amount of the pitch. A fin is provided on the base body so that the fin can be easily pushed and pulled only by one finger even when a player holds a pick.

For adjusting the shift amount, since a pivot point, a shift action point and the shift amount adjust screw are arranged in this order, the shift action amount is smaller than the adjust amount of the shift amount adjust screw. Thus, the shift amount can be finely adjusted.

In addition, since an extension line of the axis line of the shift amount adjust screw crosses the axis line of the sliding direction, the rotational moment generated at the shift amount adjust screw is theoretically zero when performing the sliding movement. Thus, the shift amount adjust screw is hardly loosened.

The shift amount adjust screw is located at a center surface of the base body. Thus, same type of drop tuner can be used for a right-handed guitar and a left-handed guitar.

BRIEF DESCRIPTION OF THE DRAWINGS

FIG. 4D shows a cross-sectional view of the saddle unit.

FIG. 9A shows a perspective view of a drop tuner of U.S. Pat. No. 5,359,144.

FIG. 9B shows a side view of a drop tuner of U.S. Pat. No. 5,359,144.

FIG. 9C shows a plan view of a drop tuner of U.S. Pat. No. 5,359,144.

FIG. 9D shows a cross-sectional view of a drop tuner of U.S. Pat. No. 5,359,144.

FIG. 9E shows a front view of a drop tuner of U.S. Pat. No. 5,359,144.

DETAILED DESCRIPTION OF THE INVENTION

Figure 1:
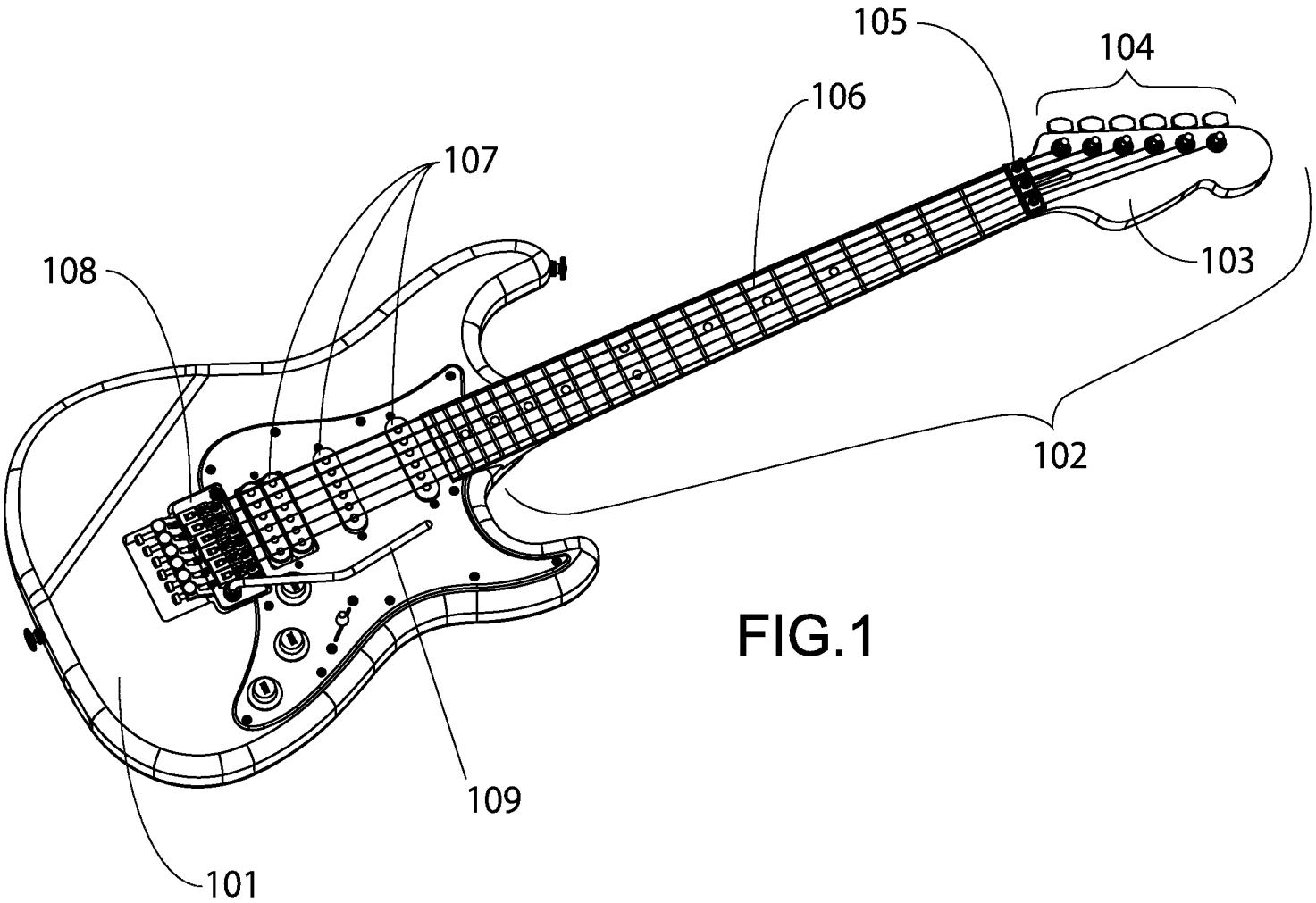
FIG. 1 shows a perspective view of an electric guitar.
Figure 2:
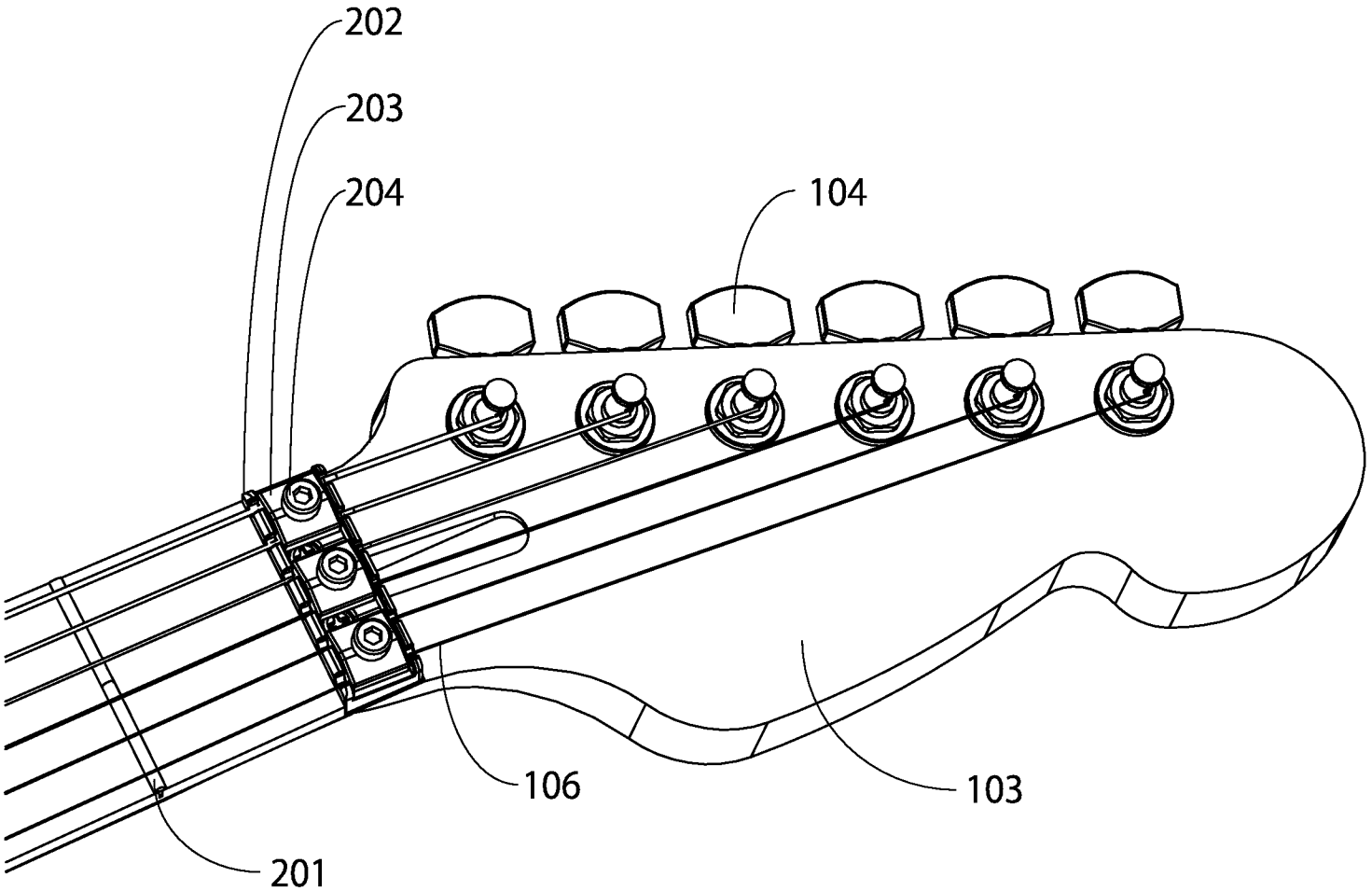
FIG. 2 shows an enlarged perspective view of a headstock part.

FIG. 1 shows an overall view of an electric guitar which has a general structure of double locking system of U.S. Pat. No. 4,171,661 and fine tuning system of U.S. Pat. No. 4,497,236. This is a type of guitar generally called "Double locking guitar", in which strings are locked at bridge end and nut end. By this way, the tuning stability after bridge 108 tremolo motion by tremolo arm 109 is maximized.

At headstock 103 of the neck 102 which is connected to a body 101, machineheads 104 are mounted and string tension can be tuned by them. One string end 106 are hooked at machinehead 104, and another string end is locked on a main saddle 302 of bridge 108, the sounds are generated by strings 106 vibrating between saddles 302 and nut 105, and the sounds are converted from physical signal to electric signal by magnetic pickups 107.

The bridge 108 are connected to springs at body back and the springs are connected to the body 101. The bridge 108 has a tremolo arm to rock the bridge backward and forward. By rocking tremolo arm 109, the bridge moves pivotally up and down around stud bolt 310 as fulcrum point. By this motion, the string pitch varies higher and lower from original pitch. To minimize going out of tune after bridge tremolo motion, the strings 106 are locked with metal nut 202 and metal pad 203 by tightening lock screw 204 after tuned by machineheads 104.

Figure 3:
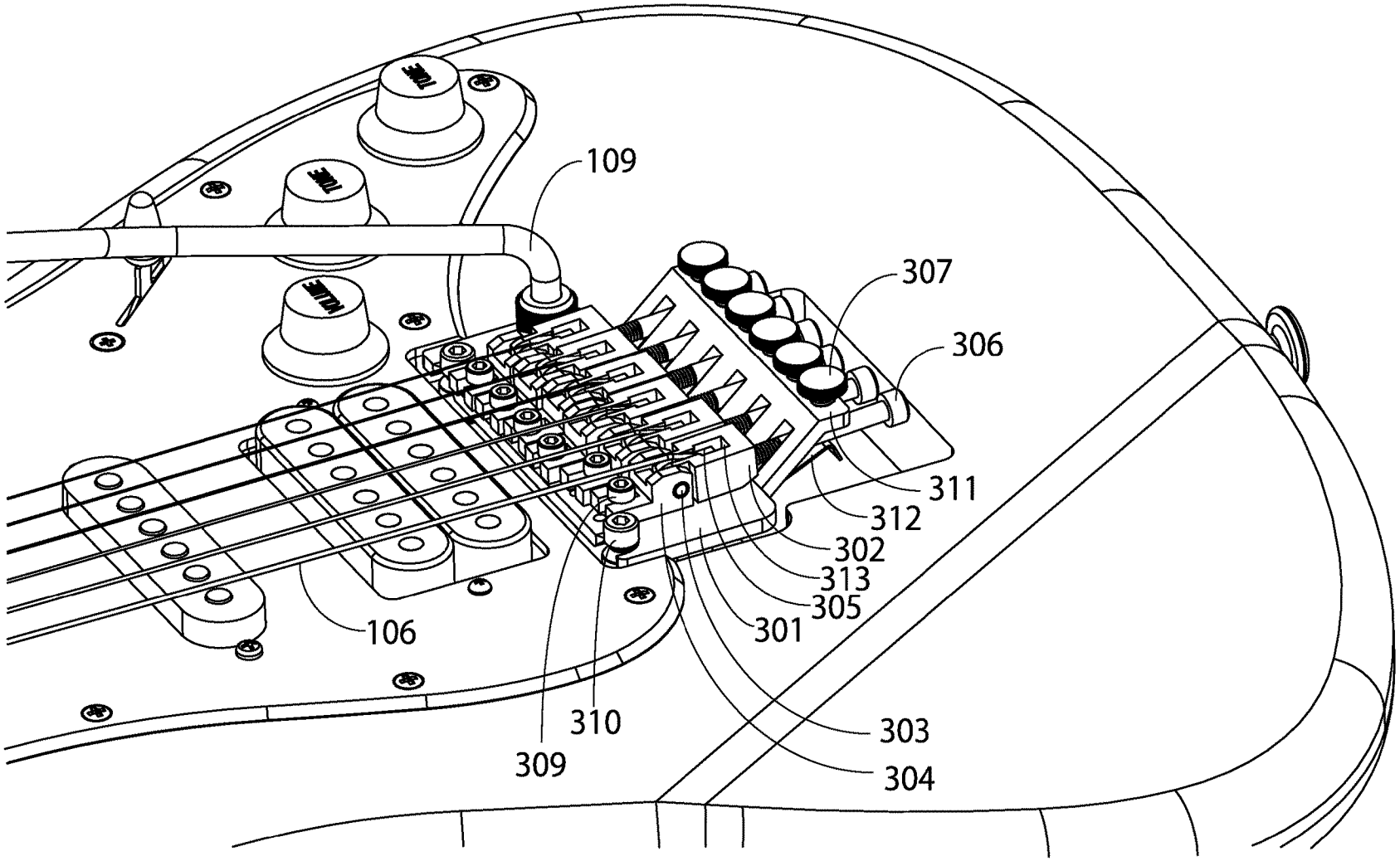
FIG. 3 shows an enlarged perspective view of a body part.
Figure 4B:
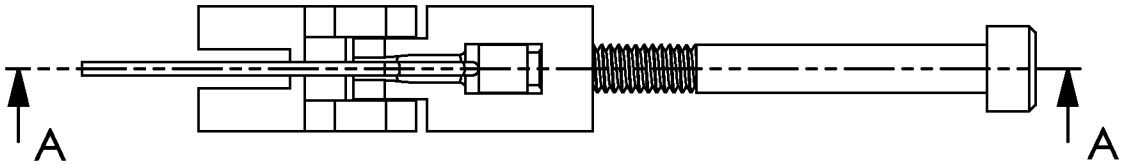
FIG. 4B shows a plan view of the saddle unit.
Figure 4C:
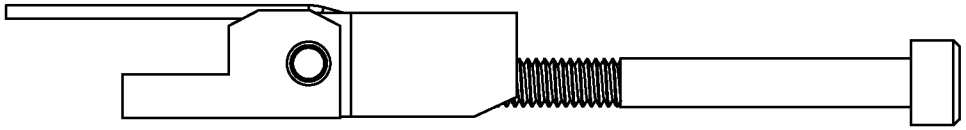
FIG. 4C shows a side view of the saddle unit.
Figure 4A:
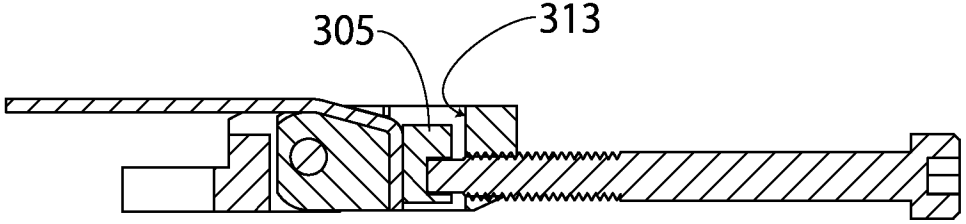
FIG. 4A shows a perspective view of a saddle unit.
Figure 4A:
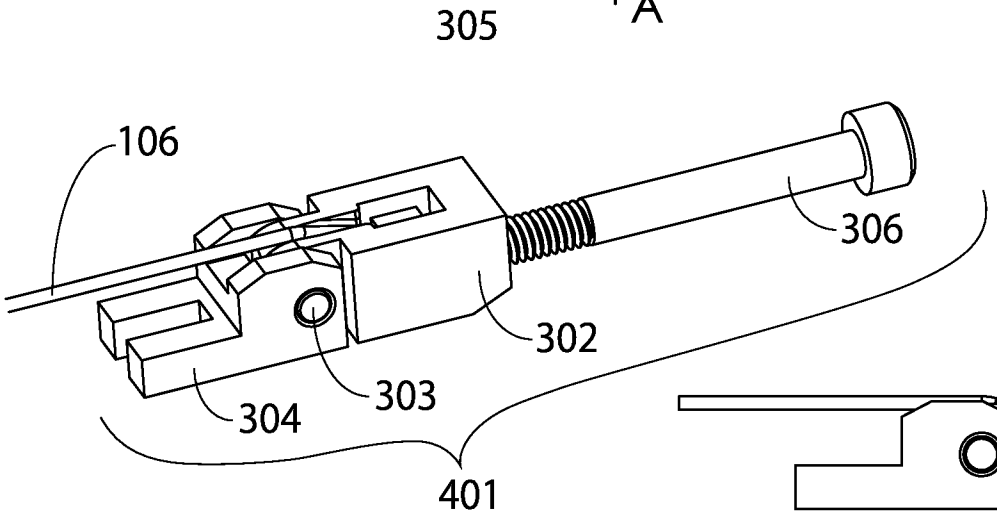

When the both sides of strings are locked, naturally, there is a problem that it is impossible to tune strings any more. If strings go out of tune even slightly, players must loosen lock screw 204 again, and tune and tighten again. It is very frustrating players. To solve this, general double locking bridge has a structure called fine tuners which is disclosed by U.S. Pat. No. 4,497,236. (FIG. 3)

A main saddle 302 is connected to a sub saddle 304 by a pin 303, so main saddle 302 can rotate around the pin 303. And the rotation angle is adjusted by fine tuning screw 307 which is screwed on the part which is elongated from baseplate, so even after locking both sides of strings 106, string tension can be tuned by rotating fine tuning screw 307, even though the tuning range is comparatively small. This structure is called "fine tuners" and to adjust by rotating fine tuning screw 307 is called "fine tuning".

Generally, the critical contact point curve 314 of main saddle 302 is designed to have the same center point as a pin 303, so the practical string length does not change by fine tuning. The strings 106 are inserted into the main saddle 302 and then locked with lock pad 305 by tightening lock screw 306.

A drop tuner for a stringed musical instruments has a pitch changing apparatus which produces two distinct pitches (lower pitch, higher pitch) for a selected string. The drop tuner of U.S. Pat. No. 5,359,144 is specially designed drop tuner for the general double locking bridge which has fine tuners as shown by U.S. Pat. No. 4,497,236.

Figure 5:
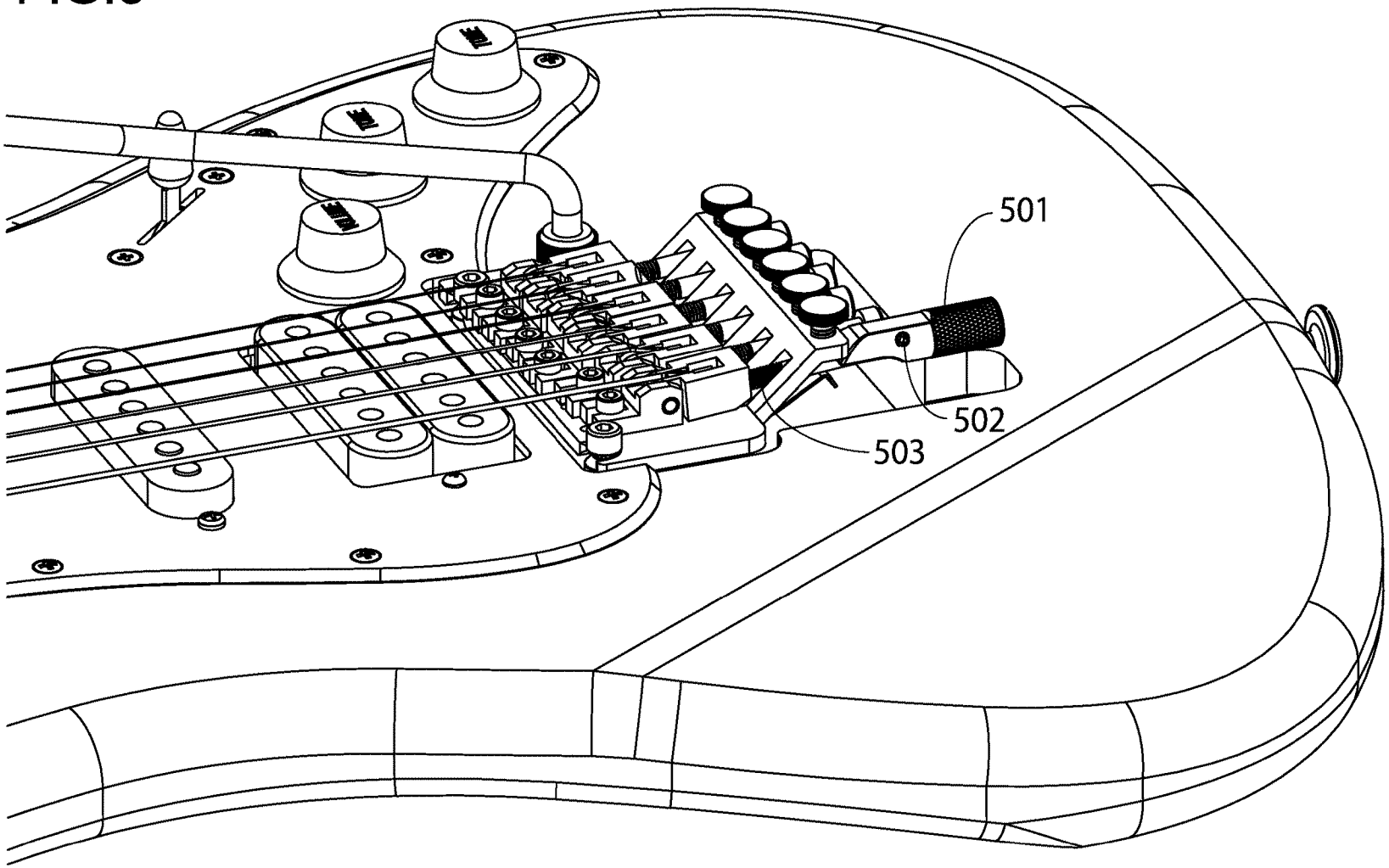
FIG.5 Related Art
FIG. 5 shows a perspective view of an electric guitar in which a drop tuner of U.S. Pat. No. 5,359,144 is installed and it is set at lower pitch side.

FIG. 5 shows a perspective view of an electric guitar in which a drop tuner of U.S. Pat. No. 5,359,144 is installed and it is set at lower pitch side. The drop tuner of U.S. Pat. No. 5,359,144 is composed by a base body 501, a shift amount adjust screw 502, a special string lock screw 503.

Figure 6:
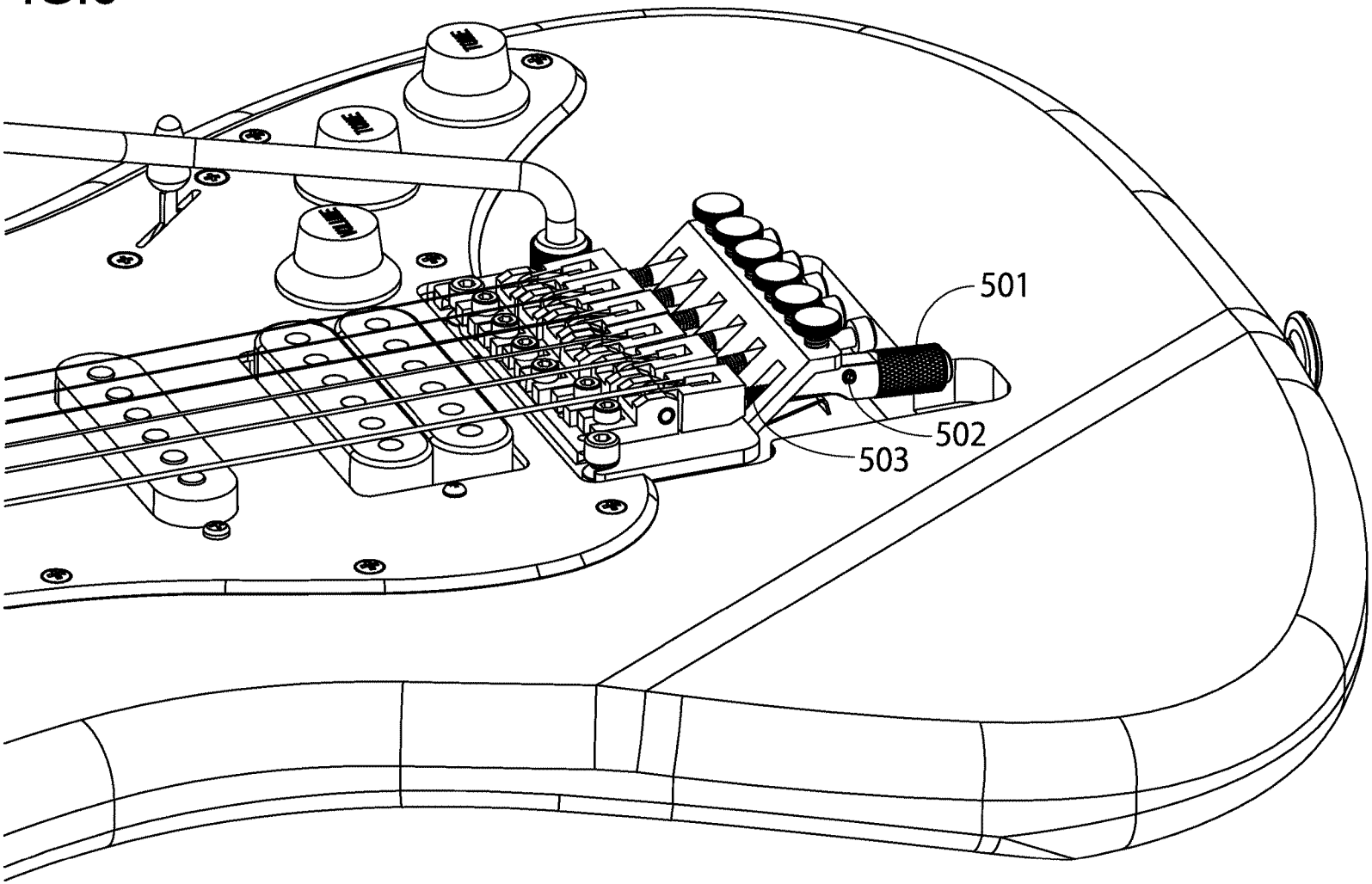
Related Art FIG.6
FIG. 6 shows a perspective view of an electric guitar in which a drop tuner of U.S. Pat. No. 5,359,144 is installed and it is set at higher pitch side.

FIG. 6 shows a perspective view of an electric guitar in which a drop tuner of U.S. Pat. No. 5,359,144 is installed and it is set at higher pitch side.

Figure 7:
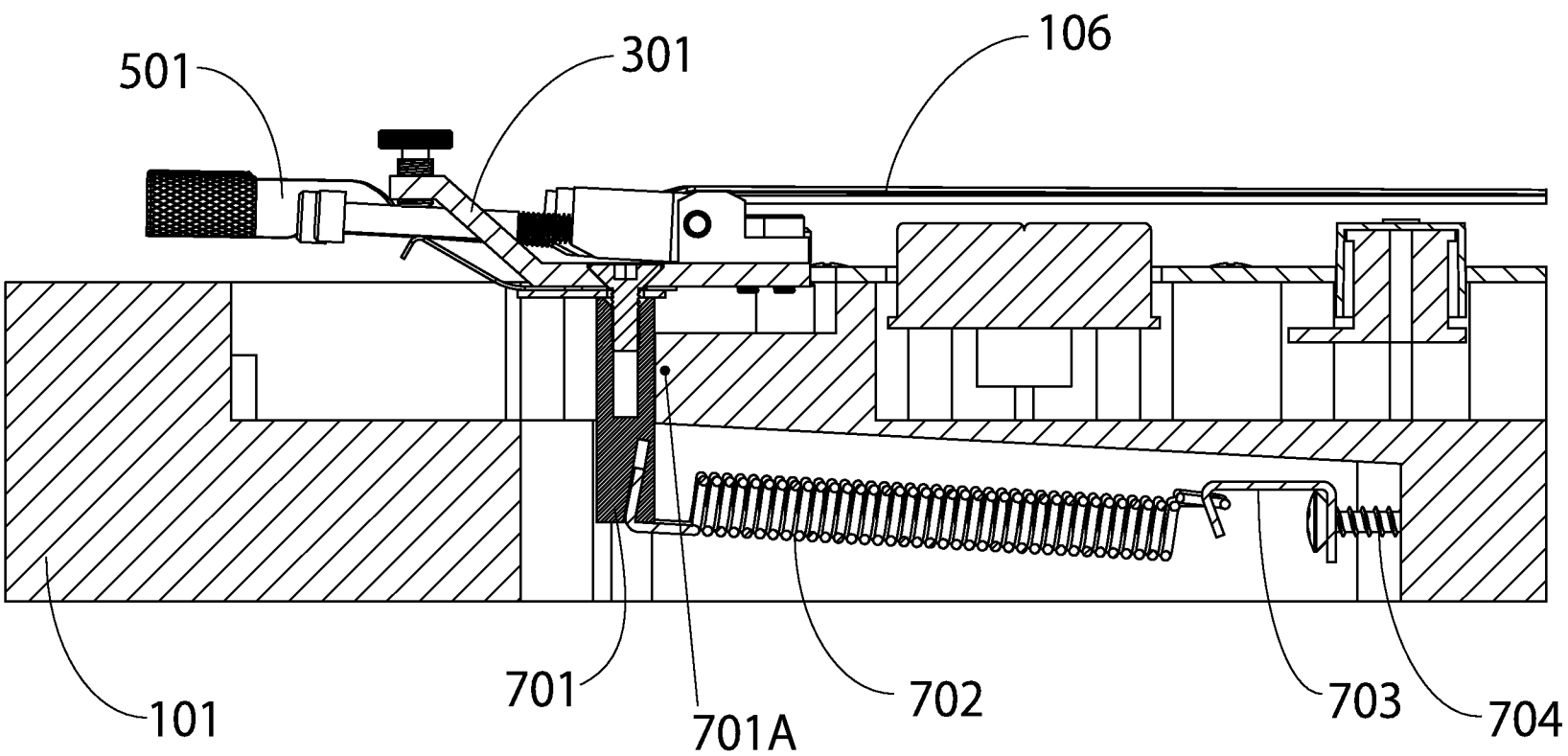
Related Art FIG.7
FIG. 7 shows a cross-sectional view of an electric guitar in which a drop tuner of U.S. Pat. No. 5,359,144 is installed.

FIG. 7 shows a cross-sectional view of an electric guitar in which a drop tuner of U.S. Pat. No. 5,359,144 is installed. A tremolo block 701 is pulled toward the guitar body 101 by counter springs 702 and stopped at stop block 701A. The bridge doesn't move as far as the rotational moment which strings and arm down motion generate does not exceed the rotational moment which these counter springs 702 generate. By this way, even if the strings tension changes by shift motion of the drop tuner of U.S. Pat. No. 5,359,144, the bridge doesn't move, so the tunings of the other strings except the selected string don't change.

Figure 8B:
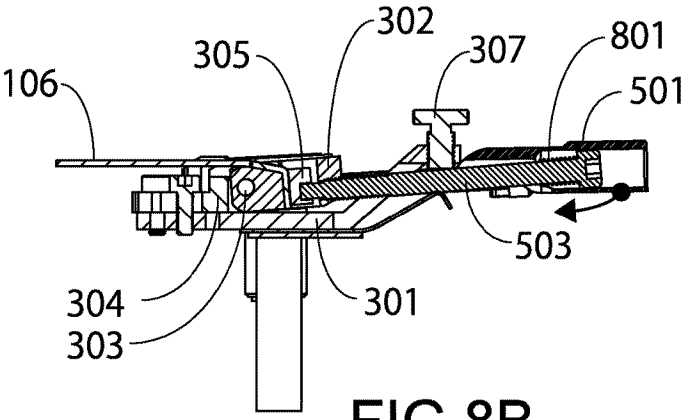
FIG. 8B shows a cross-sectional view of a guitar bridge in which a drop tuner of U.S. Pat. No. 5,359,144 is installed and it is set at lower pitch side.
Figure 8D:
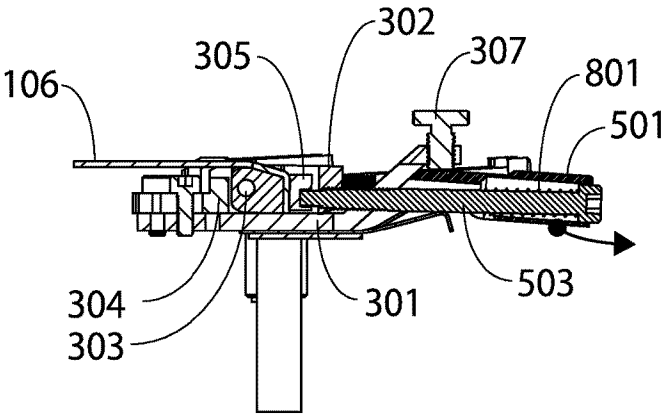
FIG. 8D shows a cross-sectional view of a guitar bridge in which a drop tuner of U.S. Pat. No. 5,359,144 is installed and it is set at higher pitch side.
Figure 8A:
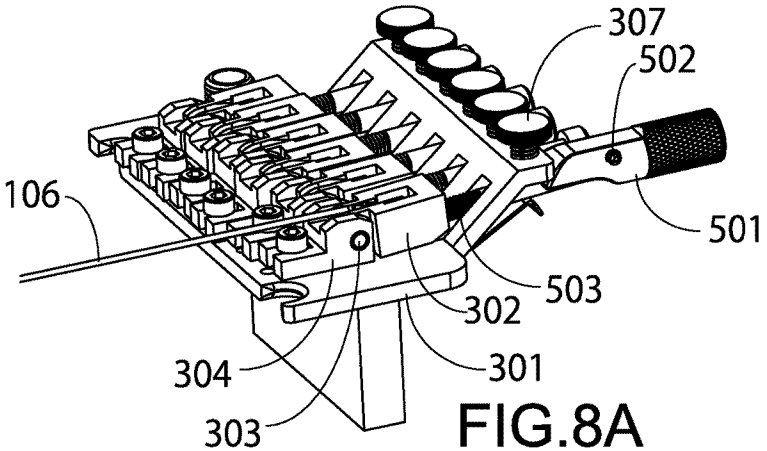
FIG. 8A shows a perspective view of a guitar bridge in which a drop tuner of U.S. Pat. No. 5,359,144 is installed and it is set at lower pitch side.
Figure 8C:
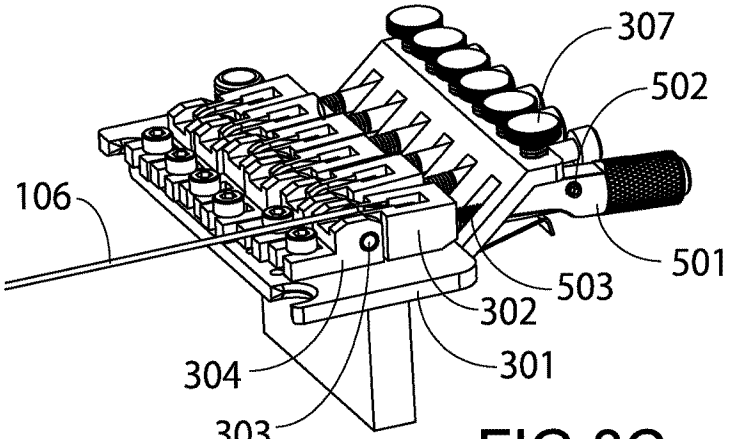
FIG. 8C shows a perspective view of a guitar bridge in which a drop tuner of U.S. Pat. No. 5,359,144 is installed and it is set at higher pitch side.

FIG. 8A shows a perspective view of a guitar bridge in which a drop tuner of U.S. Pat. No. 5,359,144 is installed and it is set at lower pitch side. FIG. 8B shows a cross-sectional view of FIG. 8A. FIG. 8C shows a perspective view of a guitar bridge in which a drop tuner of U.S. Pat. No. 5,359,144 is installed and it is set at higher pitch side. FIG. 8D shows a cross-sectional view of FIG. 8C.

When the drop tuner of U.S. Pat. No. 5,359,144 is set at lower pitch side (FIG. 8A, FIG. 8B), the fine tuning screw 307 and the special string lock screw 503 come in contact with each other. The base body 501 is pushed toward the bridge baseplate 301 by spring 801, and they touch each other by slight force. From this lower pitch state, by holding and pushing the base body 501 by thumb and index finger toward the baseplate 301, the base body 501 is inserted between fine tuning screw 307 and the special string lock screw 503. By this motion, the main saddle 302 rotates some amount clockwise around the pin 303 and the string 106 pitch is shifted from lower pitch to higher pitch. The shift amount adjust screw 502 adjusts the insert amount of base body 501 between fine tuning screw 307 and the special string lock screw 503. For shifting from higher pitch to lower pitch, player pinch the base body 501 between thumb and index finger and pull back like the direction of FIG. 8D's arrow. Thus, player can change tuning immediately between two distinct pitches for selected strings.

FIG. 9A to 9E shows multi views of a drop tuner of U.S. Pat. No. 5,359,144. This drop tuner composed by a base body 501, a shift amount adjust screw 502, a special string lock screw 503, and a spring 801. The spring 801 is for keeping contact between base body 501 and bridge baseplate 503. Player pushes forward and pulls back this drop tuner by pinching the grip part 501A between thumb and index finger. But generally, player pinches a pick between thumb and index finger on his right hand for playing the guitar, so he has to pass the pick to other fingers to operate this drop tuner of U.S. Pat. No. 5,359,144. This passing operation will be a kind of stress when the interval between songs is too short.

Other problem of the drop tuner of U.S. Pat. No. 5,359,144 is that it is difficult to adjust the shift amount precisely because of the structure. The order of physical adjustment points location is, shift action point, adjust point, pivot point as FIG. 9D. And direction L which is the motion direction of shift amount adjust screw 502, and direction M which is the motion direction of base body 501 which occurs by shift amount adjust screw 502 are not the same. By these two reasons, the shift action amount is larger than adjust amount, thus it is difficult to set the shift amount precisely.

Other problem of the drop tuner of U.S. Pat. No. 5,359,144 is that extension line of shift amount adjust screw's axis and the axis of string lock screw which is the axis of shift slide motion don't cross as FIG. 9E, so rotational moment will be generated on the shift amount adjust screw 502 tip by shift motion. By this way, the shift amount adjust screw 502 tends to rotate easily and the shift amount will be unstable.

And the location of the shift amount adjust screw 502 is not on the centerline Y of base body. So, the shift amount adjust screw 502 location is better to be changed to the opposite side for left handed guitar players. By this thought, it is better to prepare for right handed model and left handed model, but it might be inventory risk.

Figure 10:
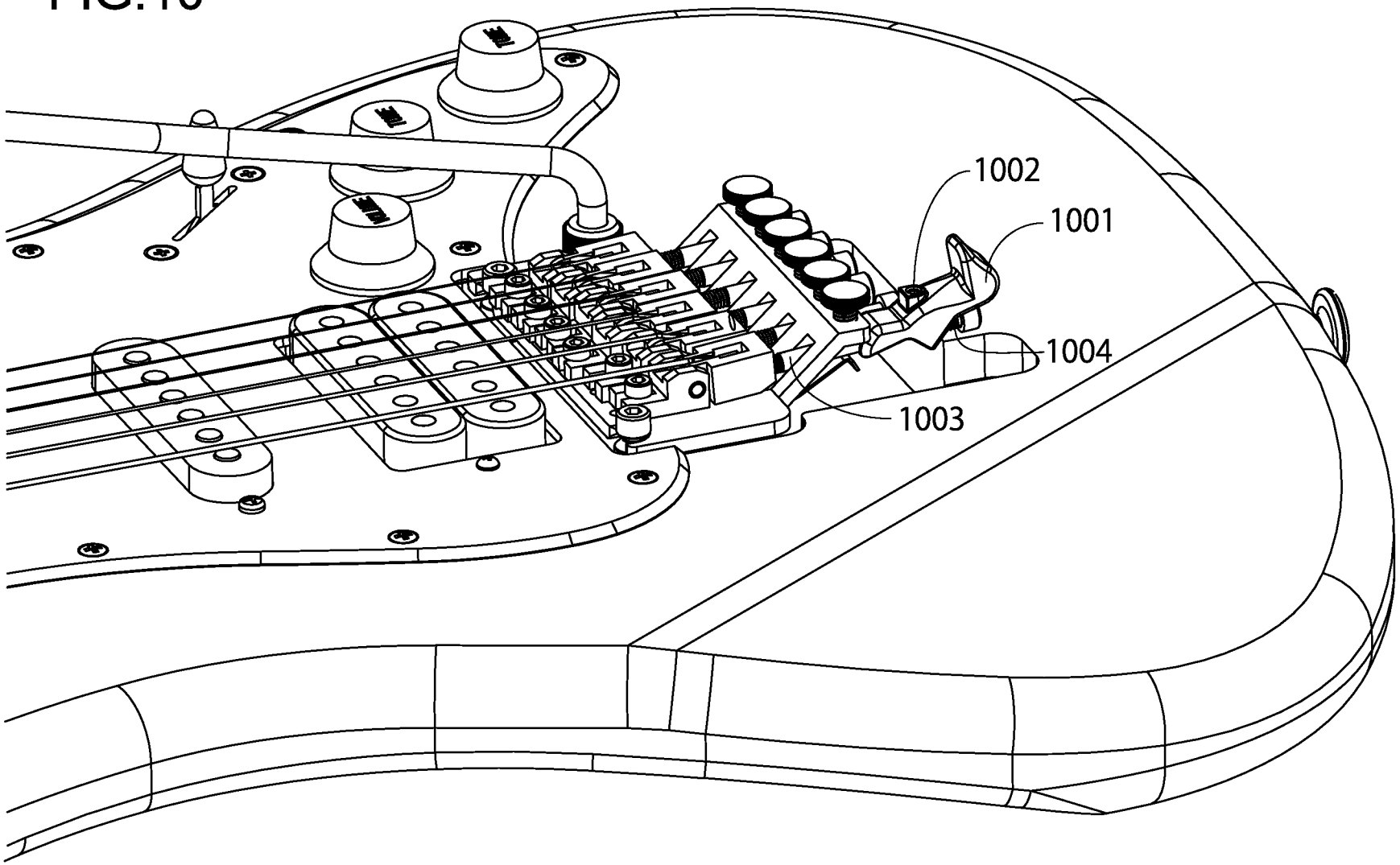
FIG. 10 shows a perspective view of an electric guitar in which a drop tuner of the present invention is installed and it is set at lower pitch side.

FIG. 10 shows a state that the drop tuner of the present invention is installed on an electric guitar and set to the lower pitch side. The drop tuner of the present invention is formed by a base body 1001, a shift amount adjust screw 1002, a special string lock screw 1003 and a spring 1004.

Figure 11:
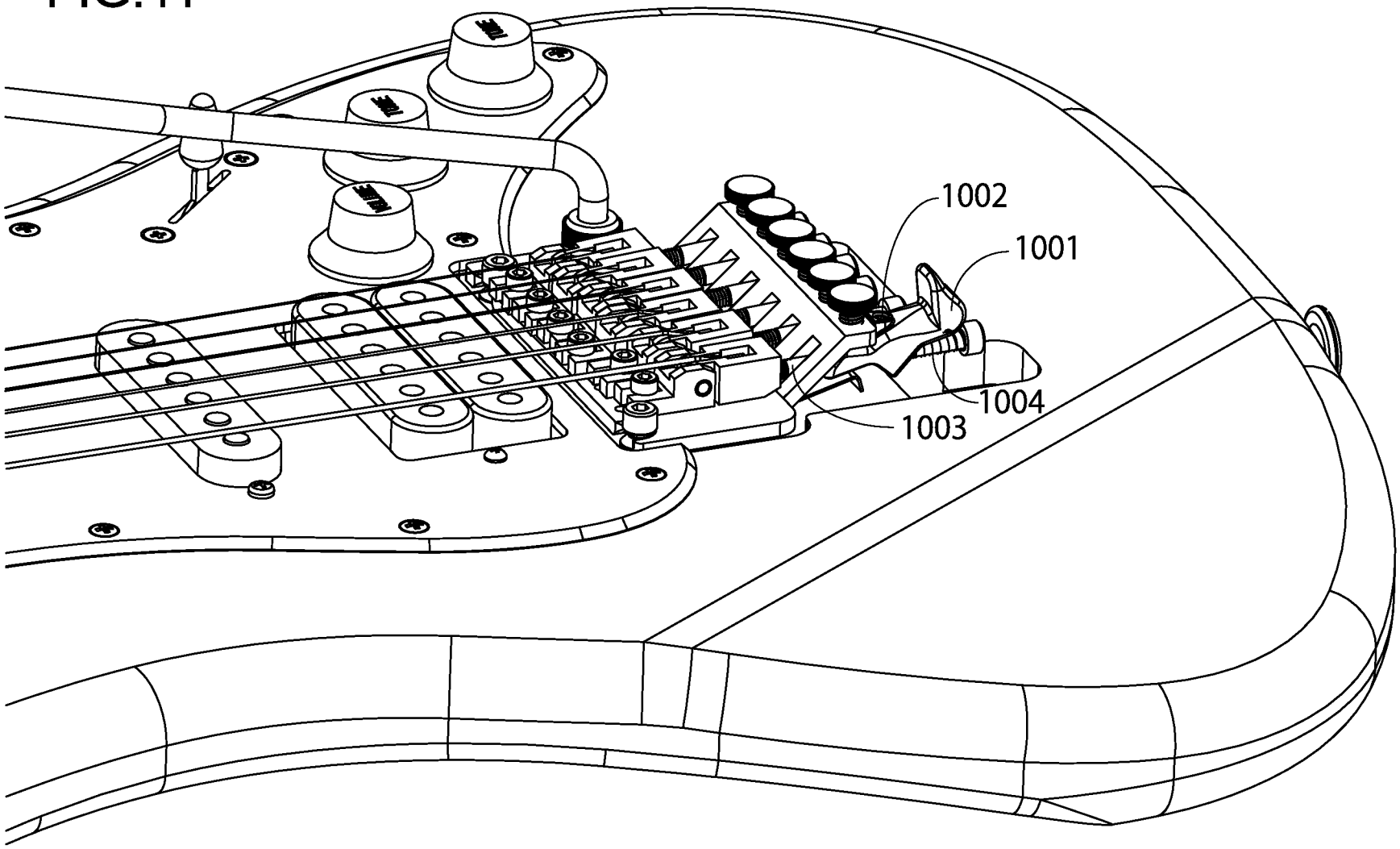
FIG. 11 shows a perspective view of an electric guitar in which a drop tuner of the present invention is installed and it is set at higher pitch side.

FIG. 11 shows a state that the drop tuner of the present invention is installed on an electric guitar and set to the higher pitch side.

Figure 12:
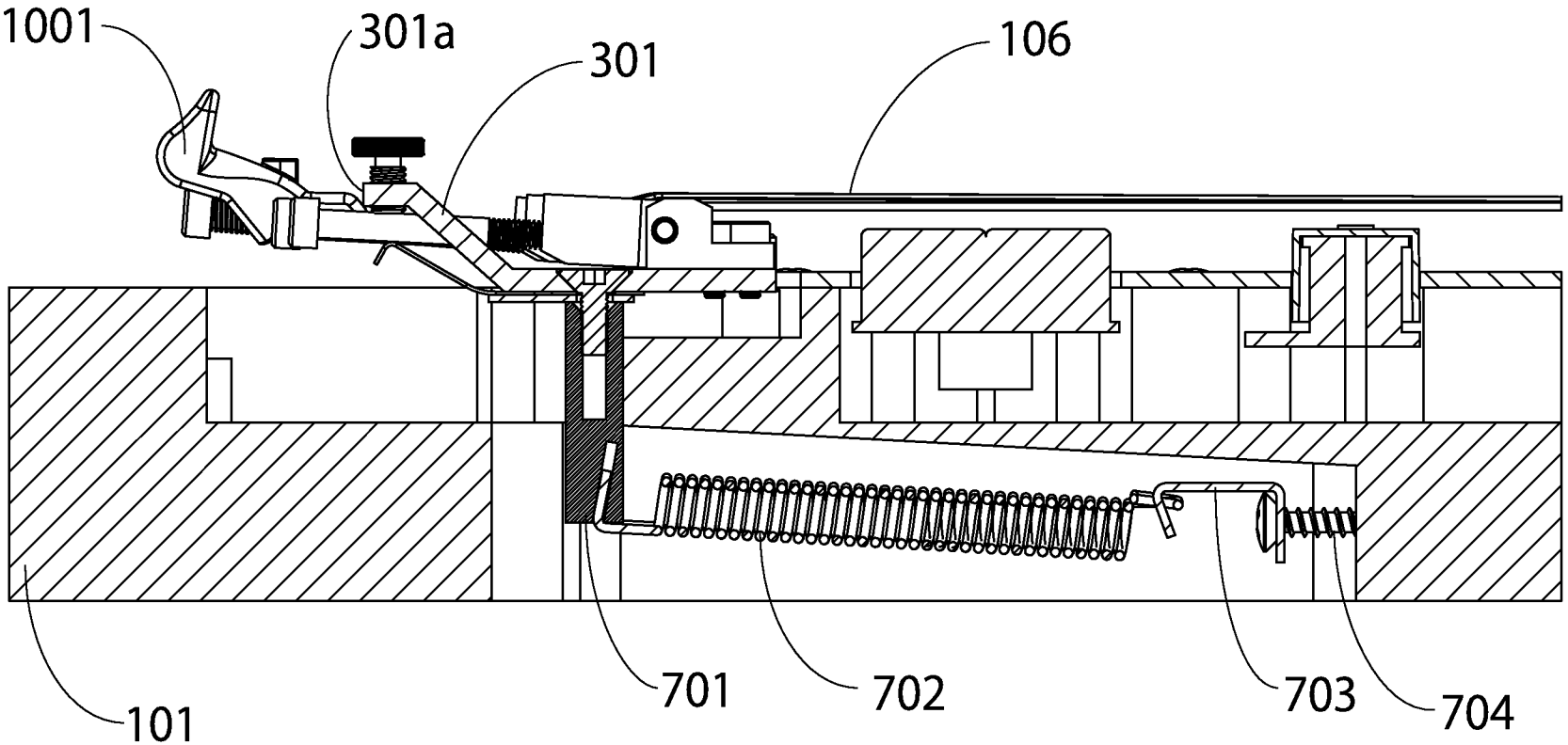
FIG. 12 shows a cross-sectional view of an electric guitar in which a drop tuner of the present invention is installed.

FIG. 12 is a cross-sectional view of an electric guitar in which the drop tuner of the present invention is installed.

Figure 13A:
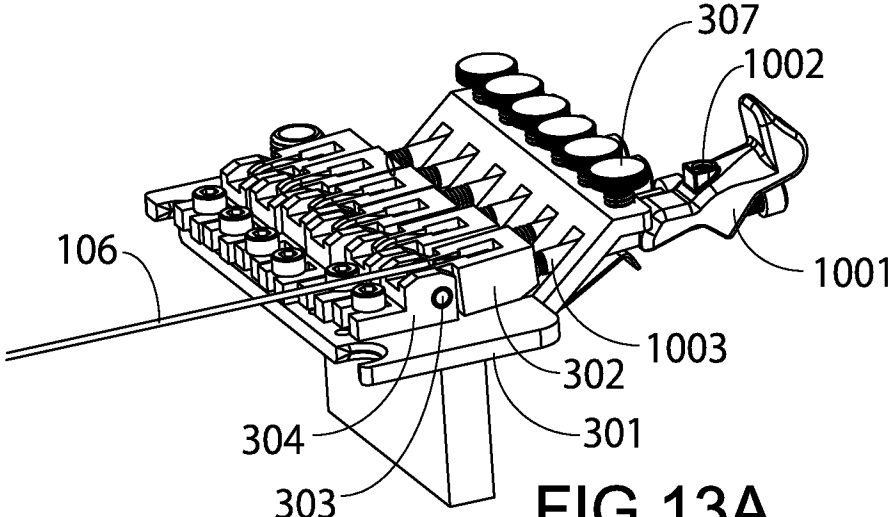
FIG. 13A shows a perspective view of a guitar bridge in which a drop tuner of the present invention is installed and it is set at lower pitch side.
Figure 13B:
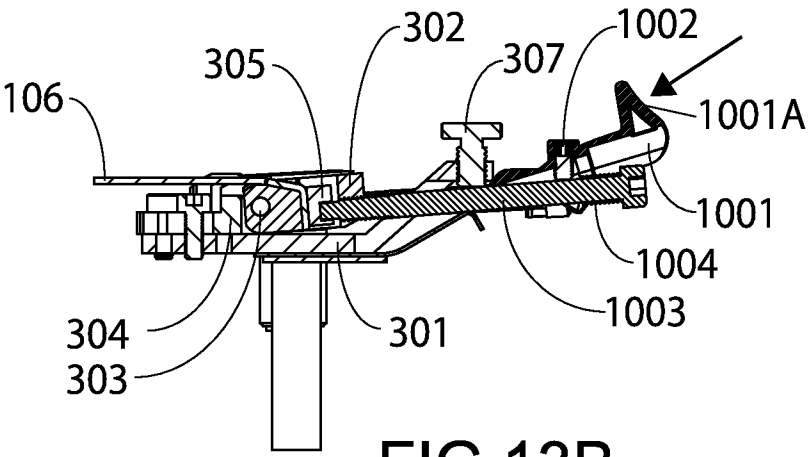
FIG. 13B shows a cross-sectional view of a guitar bridge in which a drop tuner of the present invention is installed and it is set at lower pitch side.
Figure 13C:
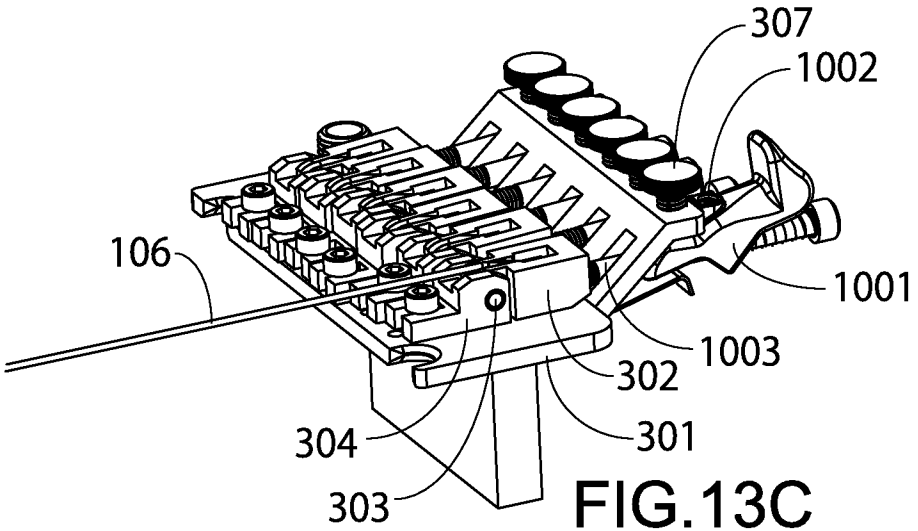
FIG. 13C shows a perspective view of a guitar bridge in which a drop tuner of the present invention is installed and it is set at higher pitch side.
Figure 13D:
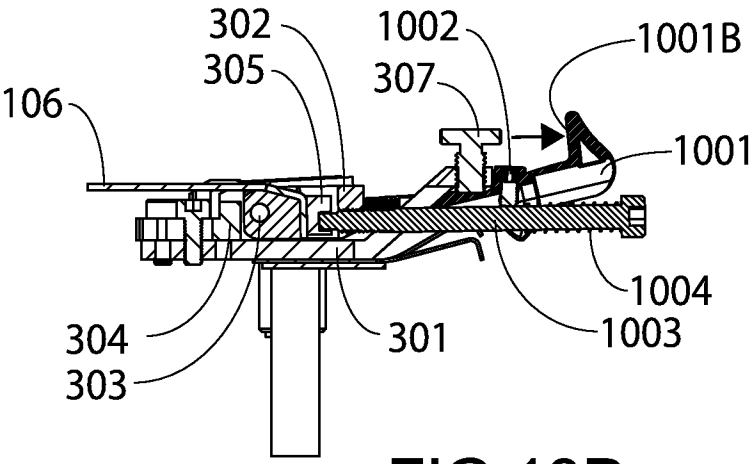
FIG. 13D shows a cross-sectional view of a guitar bridge in which a drop tuner of the present invention is installed and it is set at higher pitch side.

FIG. 13A shows a state that the drop tuner of the present invention is installed on the double locking bridge which has fine tuners as shown by U.S. Pat. No. 4,497,236 and set to the lower pitch side. FIG. 13B is a cross-sectional view of FIG. 13A. FIG. 13C shows a state that the drop tuner of the present invention is installed on the double locking bridge which has fine tuners as shown by U.S. Pat. No. 4,497,236 and set to the higher pitch side. FIG. 13D is a cross-sectional view of FIG. 13C.

The base body 1001 extends in a longitudinal direction of the special string lock screw 1003. The base body 1001 has an approximately U-shape in cross-section. The base body 1001 is installed so as to surround an axis of the special string lock screw 1003. An opening side of the U-shaped base body 1001 is directed to an opposite side of the fine tuning screw 307. Namely, the base body 1001 has an approximately U-shape in cross-section, and the base body 1001 is arranged so that the fine tuning screw 307 side of the special string lock screw 1003 is surrounded by the base body 1001 and an opposite side is open.

The base body 1001 has a body part 1001*a* which is directed in a longitudinal direction of the special string lock screw 1003 and substantially penetrated by the special string lock screw 1003 and supported by the special string lock screw 1003 at an end portion farther from the main saddle 302 and another end portion nearer to the main saddle 302. A front end portion 1001*a*1 of the body part 1001*a* is penetrated by the special string lock screw 1003 at the end portion nearer to the main saddle 302 and loosely fixed to the special string lock screw 1003 so that the body part 1001*a* can be inclined against the special string lock screw 1003. Although the front end portion 1001*a*1 is loosely fixed to the special string lock screw 1003, the front end portion 1001*a*1 is not detached from the special string lock screw 1003 when the special string lock screw 1003 is inclined. On the other hand, a rear end portion 1001*a*2 is penetrated by the special string lock screw 1003 at the end portion farther from the main saddle 302 and formed into a long hole shape. Because of the long hole shape, the special string lock screw 1003 can be moved within the range of the long hole. Consequently, the body part 1001*a* can be inclined and can be approached to the special string lock screw 1003 and separated from the special string lock screw 1003.

Furthermore, a shift amount adjust screw 1002 is provided on the body part 1001*a* near the portion on which the long hole is formed to penetrate the body part 1001*a*. The shift amount adjust screw 1002 is screwed to the body part 1001*a* to project toward an axis of the special string lock screw 1003. The shift amount adjust screw 1002 is directed to abut an axis line of the special string lock screw 1003 approximately at right angles. A tip of the shift amount adjust screw 1002 is in contact with a side surface of the special string lock screw 1003. The angle between the body part 1001*a* and the special string lock screw 1003 can be adjusted by rotating the shift amount adjust screw 1002.

As explained above, the axis line of the shift amount adjust screw 1002 is arranged on a center surface of the body part 1001*a* of the base body 1001 and the axis line of the shift amount adjust screw 1002 is arranged to cross the axis line of the special string lock screw 1003.

When the angle between the body part 1001*a* and the special string lock screw 1003 is small, the degree of separating the special string lock screw 1003 from the fine tuning screw 307 is small. When the angle between the body part 1001*a* and the special string lock screw 1003 is large, the degree of separating the special string lock screw 1003 from the fine tuning screw 307 is large. According to the degree of separating the special string lock screw 1003 from the fine tuning screw 307, the degree of separating the pitch varies when the pitch is shifted to the higher pitch.

Here, when the special string lock screw 1003 is inclined by the base body 1001, a contact point between the front end portion 1001*a*1 of the body part 1001*a* and the special string lock screw 1003 functions as a pivot point, a contact point between the body part 1001*a* and the fine tuning screw 307 functions as an action point, and a contact point between the shift amount adjust screw 1002 and the special string lock screw 1003 functions as an adjust point. Since the action point is located between the adjust point and the pivot point, the displacement of the action point is small with respect to the displacement of the adjust point. Thus, the shift amount can be finely adjusted. As explained above, the pivot point is located at the front side (main saddle side) with respect to the action point of the shift amount adjust screw 1002.

The fine tuning screw 307 is screwed to a bridge baseplate 301 which extends in a longitudinal direction of the special string lock screw 1003 to penetrate the bridge baseplate 301. The fine tuning screw 307 is supported by the bridge baseplate 301 to abut an axis of the special string lock screw 1003. The bridge baseplate 301 includes an edge part 301*a* having a straight line perpendicular to the special string lock screw 1003 at the end portion opposite to the main saddle 302.

The end portion of the main saddle 302 side of the base body 1001 has an inclined surface 1001*b* which abuts the edge part 301*a* of the bridge baseplate 301. Since the inclined surface 1001*b* is in contact with the edge part 301*a*, a part of the base body 1001 can be moved toward the special string lock screw 1003 at the main saddle 302 side.

When the base body 1001 is pushed toward the main saddle 302 side, the base body 1001 is inserted between the bridge baseplate 301 and the special string lock screw 1003 and contacted with the fine tuning screw 307. Furthermore, the base body 1001 has a positioning protrusion 1001*c* which abuts an end portion of the bridge baseplate 301 when the base body 1001 is inserted at a predetermined distance. Since the positioning protrusion 1001*c* is formed, the base body 1001 is prevented from moving further toward the main saddle 302 side. According to the protruded length of the shift amount adjust screw 1002 which penetrates thorough the body part 1001*a* and protruded toward the special string lock screw 1003 at this position, the angle of the special string lock screw 1003 inclined by the base body 1001 is determined. Namely, the rotation angle of the main saddle 302 rotated around a pin 303 is determined.

Note that the shift amount adjust screw 1002 is screwed to a further side of the main saddle 302 with respect to the positioning protrusion 1001*c*. More specially, the positioning protrusion 1001*c* has a shape on which a female screw hole can be formed so that the shift amount adjust screw 1002 can be screwed into the female screw hole. The shift amount adjust screw 1002 is screwed to an opposite side of the main saddle 302 with respect to a contact position contacted with the bridge baseplate 301.

Figure 16:
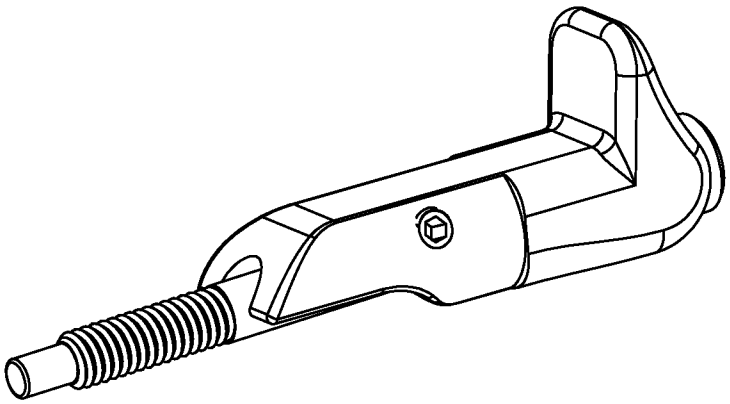
FIG. 16 is a modified example of a drop tuner of the present invention.
Figure 15:
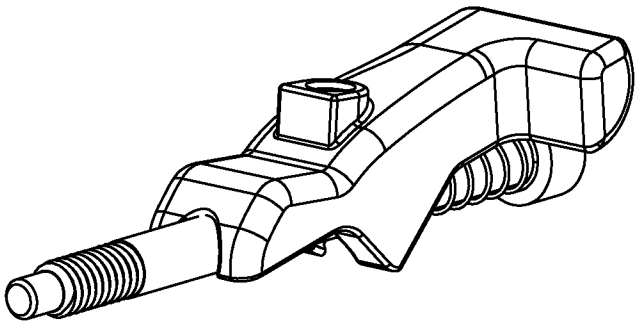
FIG. 15 is a modified example of a drop tuner of the present invention.

A fin member 1001*d* is formed on the end portion of the base body 1001 at the position farthest from the main saddle 302. The fin member 1001*d* is projected toward a surface of a guitar on which the drop tuner is installed. As shown in FIG. 15, a fin member 2001*d* is also operable by being projected upward of the guitar on which the drop tuner is installed. As shown in FIG. 16, a fin member 3001*d* can be also formed on the conventional base body 501. In the conventional base body 501, since the fin member is projected to be orthogonal to the radial direction of the lock screw 1003 from the end portion opposite to the main saddle 302, the fin member 3001*d* can be operated to shift the base body 501 while holding a pick.

The fin member 1001*d* has a front surface 1001*d*1 located at the main saddle 302 side and a rear surface 1001*d*2 located at an opposite side of the main saddle 302. The front surface 1001*d*1 is formed to be approximately perpendicular to the special string lock screw 1003. The rear surface 1001*d*2 is formed to be an inclined surface approaching the special string lock screw 1003 as separated from the main saddle 302.

The front surface 1001*d*1 is approximately perpendicular to the special string lock screw 1003 so that the fingers can be easily hooked when the base body 1001 is pushed toward the direction of separating from the main saddle 302 along the axis line direction of the special string lock screw 1003. The rear surface 1001*d*2 is a surface to be hooked by the finger when the base body 1001 is pushed toward the direction of approaching to the main saddle 302 along the axis line direction of the special string lock screw 1003. At that time, the inclined surface 1001*b* located at the front end of the base body 1001 should be moved under the edge part 301*a*. Therefore, in order to act a part of the force of pushing in the axis line direction to also in the direction perpendicular to the axis line (i.e., direction of pushing the inclined surface 1001*b* of the base body 1001 downward), the rear surface 1001*d*2 has the inclined surface approaching the special string lock screw 1003 as separated from the main saddle 302.

As explained above, a drop tuner of the present invention has: a lock screw 1003 projected from a main saddle 302 which is rotatably supported by the drop tuner; and a base body 1001 supported by the lock screw 1003 so as to be capable of being inserted between the lock screw 1003 and a fine tuning screw 307 and separated from the fine tuning screw 307, wherein a rotation angle of the main saddle 302 varies when the base body 1001 is switched between an inserted state and a separated state, and a fin member 1001*d* projected toward a radial direction of the lock screw 1003 is provided on the base body 1001 near an end portion farther from the main saddle 302. In addition, a coil spring 1004 is installed to prevent the base body 1001 from being rattled against the special string lock screw 1003.

In a state of being shifted to the lower pitch side, the fine tuning screw 307 and the special string lock screw 1003 are engaged with each other and the base body 1001 is in light contact with the bridge baseplate 301 by the spring 1004. From the state of being shifted to the lower pitch side, a part 1001A of the base body 1001 is pushed in the arrow direction shown in FIG. 13B by using a middle finger or a ring finger while holding a pick. As a result, the base body 1001 enters between the fine tuning screw 307 and the special string lock screw 1003.

Consequently, the main saddle 302 which locks a string 106 is rotated clockwise around a pin 308 by a predetermined amount. Thus, the tuning of the string 106 is shifted from the lower pitch side to the higher pitch side.

The shift amount adjust screw 1002 adjust the amount (length) of entering the base body 1001 between the fine tuning screw 307 and the special string lock screw 1003.

When the tuning is shifted from the higher pitch side to the lower pitch side, a part 1001B is pushed rearward (in the arrow direction shown in FIG. 13D) by using a middle finger or a ring finger while holding a pick. Consequently, the tuning is set to the lower pitch side. Namely, the pitch is lowered.

As explained above, the tuning of the specific string can be shifted immediately between two pitches without changing the fingers holding the pick.

FIGS. 14A to 14E are schematic diagrams of the drop tuner of the present invention. The drop tuner is formed by the special string lock screw 1003 penetrating the base body 1001, the spring 1004 installed between the base body 1001 and the special string lock screw 1003, and the shift amount adjust screw 1002. The spring 1004 is provided to always push the base body 1001 forward with a small force to prevent the base body 1001 from being rattled when shifted to the lower pitch side.

Figures 14A, 14B, 14C, 14D, 14E:
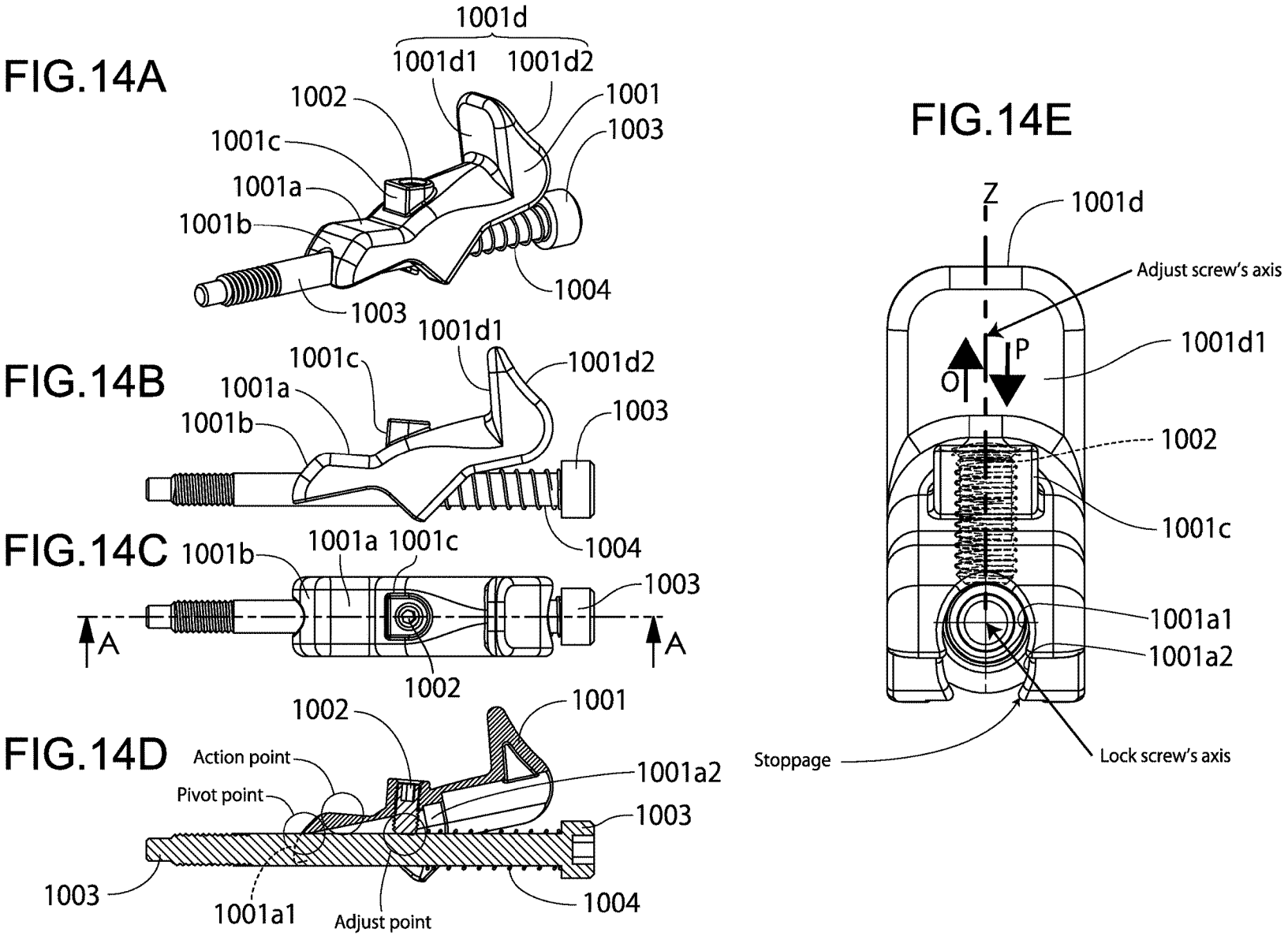
FIG. 14A shows a perspective view of a drop tuner of the present invention.
FIG. 14B shows a side view of a drop tuner of the present invention.
FIG. 14C shows a plan view of a drop tuner of the present invention.
FIG. 14D shows a cross-sectional view of a drop tuner of the present invention.
FIG. 14E shows a front view of a drop tuner of the present invention.

As shown in FIG. 14D, the pivot point, the action point and the adjust point are arranged in this order and the motion direction P of the shift amount adjust screw 1002 is same as the motion direction O of the base body, the displacement of the action point is small with respect to the displacement of the adjust point. Thus, the shift amount can be finely adjusted.

Furthermore, as shown in FIG. 14E, the axis line of the shift amount adjust screw 1002 and the axis line of the special string lock screw 1003 intersect with each other. Thus, the rotational moment generated at the shift amount adjust screw 1002 is theoretically zero when performing the shifting movement. Thus, the shift amount adjust screw 1002 is hardly loosened.

In addition, since the position of the shift amount adjust screw 1002 is located on a center line Z, the same drop tuner can be used also for a left-handed guitar.

What is claimed is:

1. A drop tuner, comprising:

a lock screw projected from a main saddle which is rotatably supported by the drop tuner; and a base body supported by the lock screw so as to be capable of being inserted between the lock screw and a fine tuning screw and separated from the fine tuning screw, wherein a rotation angle of the main saddle varies when the base body is switched between an inserted state and a separated state, and a fin member projected toward a radial direction of the lock screw is provided on the base body near an end portion farther from the main saddle.

2. The drop tuner according to claim 1, wherein the fin member is projected toward a surface of a guitar on which the drop tuner is installed or projected upward of the guitar on which the drop tuner is installed.

3. The drop tuner according to claim 1, wherein the fin member has a surface of approximately perpendicular to the lock screw at the main saddle side of the fin member, and the fin member has an inclined surface approaching the lock screw as separated from the main saddle at an opposite side of the main saddle side of the fin member.

4. The drop tuner according to claim 1, wherein the base body extends in a longitudinal direction of the lock screw, the base body has a body part which is substantially penetrated by the lock screw and supported by the lock screw at the end portion farther from the main saddle and another end portion nearer to the main saddle, the end portion of the body part farther from the main saddle has a long hole shape so that the body part can be approached to the lock screw and separated from the lock screw, and a shift amount adjust screw is provided to penetrate the body part and screwed to the body part to project toward an axis of the lock screw.

5. The drop tuner according to claim 1, wherein the fine tuning screw is screwed to a bridge baseplate which extends in a longitudinal direction of the lock screw to penetrate the bridge baseplate, the fine tuning screw is supported by the bridge baseplate to abut an axis of the lock screw, another end portion of the base body nearer to the main saddle abuts the bridge baseplate, and the another end portion has an inclined surface so that a part of the base body can be moved toward the lock screw side.

6. The drop tuner according to claim 1, wherein the base body has a positioning protrusion which abuts on an end portion of the bridge baseplate to function as a positioning member when the base body is inserted between the bridge baseplate and the lock screw and contacted with the fine tuning screw.

7. The drop tuner according to claim 6, wherein the shift amount adjust screw is screwed to an opposite side of the main saddle with respect to the positioning protrusion.

8. The drop tuner according to claim 1, wherein the base body has an approximately U-shape in cross-section, and the base body is arranged so that the fine tuning screw side of the lock screw is surrounded by the base body and an opposite side is open.

9. The drop tuner according to claim 1, wherein a pivot point is located at the main saddle side with respect to an action point of a shift amount adjust screw.

10. The drop tuner according to claim 1, wherein an axis line of the shift amount adjust screw is arranged to cross the axis line of the lock screw.

11. The drop tuner according to claim 1, wherein an axis line of the shift amount adjust screw is arranged on a center surface of the base body.

* * * * *